US009693661B2

(12) United States Patent
Lin

(10) Patent No.: US 9,693,661 B2
(45) Date of Patent: Jul. 4, 2017

(54) DUAL DISPENSING HAND SANITIZER DEVICE

(71) Applicant: Daniel Lin, San Francisco, CA (US)

(72) Inventor: Daniel Lin, San Francisco, CA (US)

(73) Assignee: Daniel Lin, San Francisco, CA (US)

( * ) Notice: Subject to any disclaimer, the term of this patent is extended or adjusted under 35 U.S.C. 154(b) by 368 days.

(21) Appl. No.: 14/274,854

(22) Filed: May 12, 2014

(65) Prior Publication Data

US 2014/0246453 A1 Sep. 4, 2014

Related U.S. Application Data

(63) Continuation-in-part of application No. 13/526,363, filed on Jun. 18, 2012, now Pat. No. 8,746,299, which is a continuation of application No. 12/582,882, filed on Oct. 21, 2009, now Pat. No. 8,225,823.

(51) Int. Cl.

| | |
|---|---|
| ***B65B 1/04*** | (2006.01) |
| ***A47K 5/12*** | (2006.01) |
| ***G07F 13/02*** | (2006.01) |
| ***G07F 17/18*** | (2006.01) |

(52) U.S. Cl.

CPC ..... *A47K 5/1217* (2013.01); *G07F 13/025* (2013.01); *G07F 17/18* (2013.01)

(58) Field of Classification Search

CPC ..... A47K 5/1217; G07F 11/64

USPC ..... 7/98, 360; 141/1

See application file for complete search history.

(56) References Cited

U.S. PATENT DOCUMENTS

| | | | | |
|---|---|---|---|---|
| 4,921,150 | A | 5/1990 | Lagergren et al. | |
| 5,890,520 | A | 4/1999 | Johnson, Jr. | |
| 6,401,009 | B1 | 6/2002 | Chandonnet | |
| 2010/0134296 | A1* | 6/2010 | Hwang | A47K 5/1217 340/573.1 |

OTHER PUBLICATIONS

"Does your gas pump ever make you feel wet and sticky"; '15 Minute Lunch'; Johnny Virgil, Jun. 27, 2005.

* cited by examiner

*Primary Examiner* — Jason K Niesz

(57) ABSTRACT

A hand sanitizer dispenser is attached to a fuel pump dispenser to provide a patron with the option to cleanse his hands after pumping fuel. The hand sanitizer includes a first dispensing outlet to dispense liquid-based hand sanitizer product; and a second dispensing outlet to dispense packaged hand sanitizer product.

19 Claims, 4 Drawing Sheets

DUAL DISPENSING HAND SANITIZER DEVICE

CROSS-REFERENCE TO RELATED APPLICATIONS

This application is a continuation-in-part of U.S. patent application Ser. No. 13/526,363 entitled "Hand Sanitizer Device for Fuel Pump Dispenser," filed on Jun. 18, 2012 and issued on Jun. 10, 2014 as U.S. Pat. No. 8,746,299, which is a is a continuation of U.S. Pat. No. 8,225,823, entitled "Hand Sanitizer Device for Fuel Pump Dispenser," filed on Oct. 21, 2009 and issued on Jul. 24, 2012, all of which are hereby incorporated by reference.

BACKGROUND

Hand sanitizer dispensers are increasingly being placed in indoor facilities, such as retail store and supermarket entrances, business lobbies, airport gates and hospital service desks. Proprietors of such indoor facilities provide these hand sanitizer dispensers as a benefit to their customers to encourage cleanliness inside the facilities and reduce the spread of pathogens. However, to date, hand sanitizer dispensers have not been as prevalently offered in outdoor public locations, in part, due to the difficulty in controlling abusive use of the dispensers (e.g., excessive use, by passersby and non-customers, etc.) and the need to environmentally harden the dispensers. In particular, fuel pump dispensers at gas stations are an ideal environment to offer hand sanitizer dispensers. Due to heavy use, fuel pump handlers tend to be extremely dirty. What is needed as a fuel pump dispensers that includes a hand sanitizer dispenser.

SUMMARY

One or more embodiments of the present invention provide a hand sanitizer dispenser comprising a first dispensing outlet to dispense liquid-based hand sanitizer product (e.g., such as a squirt of gel or foam, etc.) and a second dispensing outlet to dispense packaged hand sanitizer product (e.g., such as a bottle of hand sanitizer). In one embodiment, the hand sanitizer dispenser is attached to a fuel pump dispenser and includes an activation circuit for activating dispensing capabilities of at least one of the first and second dispensing outlets, wherein the activation circuit is configured to receive an activation signal from a computer system of the fuel pump dispenser and activate the at least one dispensing outlet in response to the receipt of the activation signal. For example, the fuel pump dispenser may request a patron to indicate whether the patron is interested in purchasing a packaged hand sanitizer product. If the fuel pump dispenser receives an indication from the patron indicating an interest in purchasing the packaged hand sanitizer product then it may transmit an activation signal to the hand sanitizer dispenser that activates a dispensing mechanism of the hand sanitizer dispenser to dispense the packaged hand sanitizer product.

A hand sanitizer dispenser that dispenses both liquid-based hand sanitizer product and packaged hand sanitizer product provides an opportunity to quickly "upsell" more expensive packaged hand sanitizer while reminding the patron to keep clean by offering the liquid-based hand sanitizer product as a courtesy (or for nominal fee). In this manner, costs of providing the hand sanitizer dispenser (and liquid-based hand sanitizer supply for it) can be offset either by the sale of the packaged hand sanitizer product (e.g., for the fuel station owner) or as a sponsorship expense, for example, by the manufacturer of the packaged hand sanitizer product.

DETAILED DESCRIPTION

Figure 1:
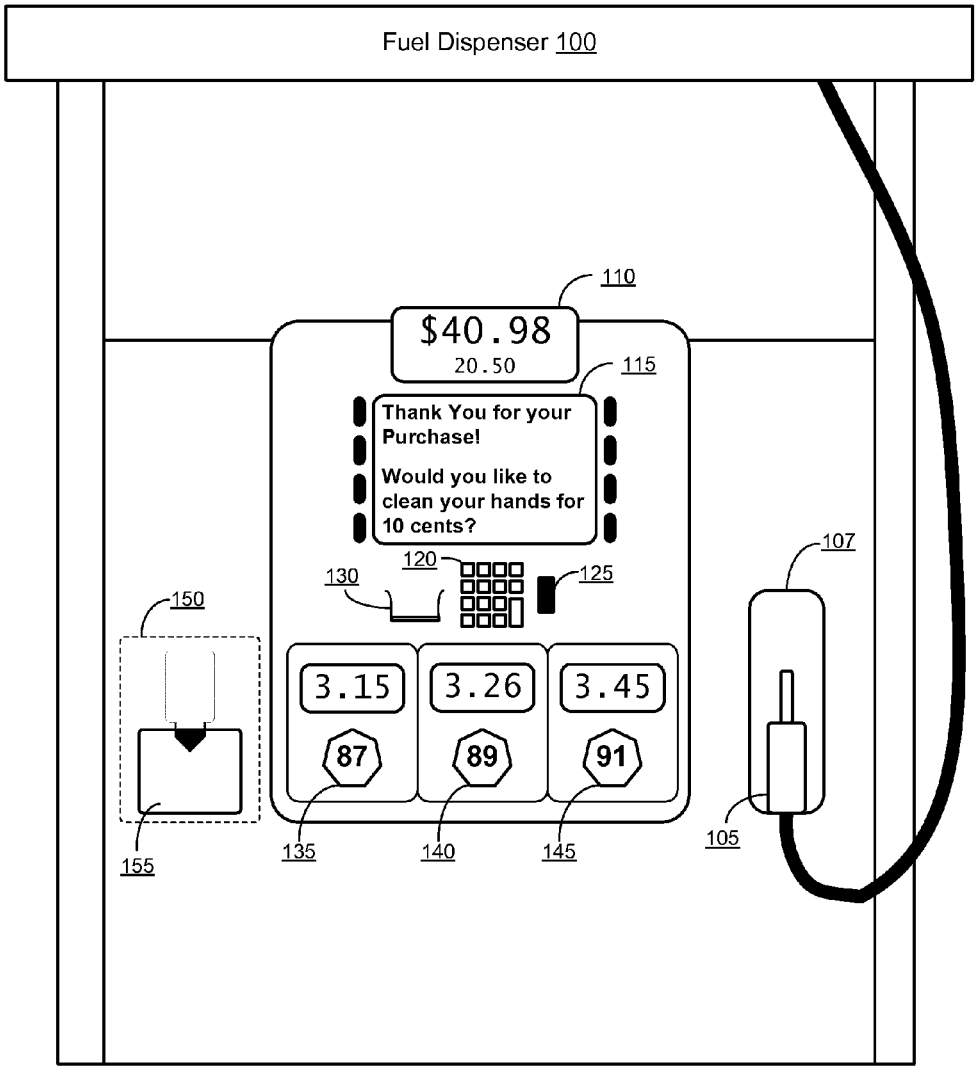
FIG. 1 depicts a fuel pump dispenser including a hand sanitizer dispenser.

FIG. 1 depicts a fuel pump dispenser including a hand sanitizer dispenser. Fuel pump dispenser 100 includes a fuel pump 105 and a price and pumped fuel amount monitor 110. Fuel pump 105 is kept in return carriage 107 when not in use. Fuel pump dispenser 100 further includes a media system display (e.g., touch screen) 115 that displays information to a customer, including, for example, promotions, advertisements and fuel pump instructions and messages. For payment transaction purposes, fuel pump dispenser 100 further includes a keypad 120, bar code and/or magnetic stripe scanner (e.g., for credit cards and identification) 125, and printer output (e.g., for receipts, etc.) 130. For fuel grade selection purposes, fuel pump dispenser 100 further includes three fuel grade selection buttons, 135-145, respectively. Fuel pump dispenser also includes a hand sanitizer compartment 150 that includes an opening 155 that provides access to a hand sanitizer, such as a liquid gel or a moist towelettes. It should be recognized fuel pump dispenser 100 is simply an example of a fuel pump dispenser that may incorporate a hand sanitizer compartment as discussed herein, and that any fuel pump dispenser may be used, consistent with the teachings herein.

Figure 2A:
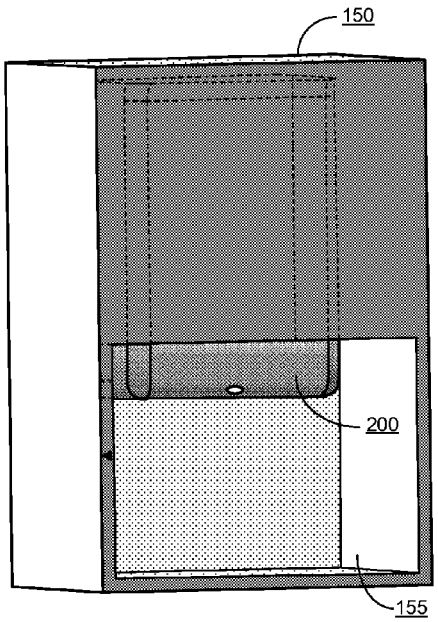
FIGS. 2A-2D depicts alternative embodiments of a hand sanitizer compartment embedded into a fuel pump dispenser.
Figure 2B:
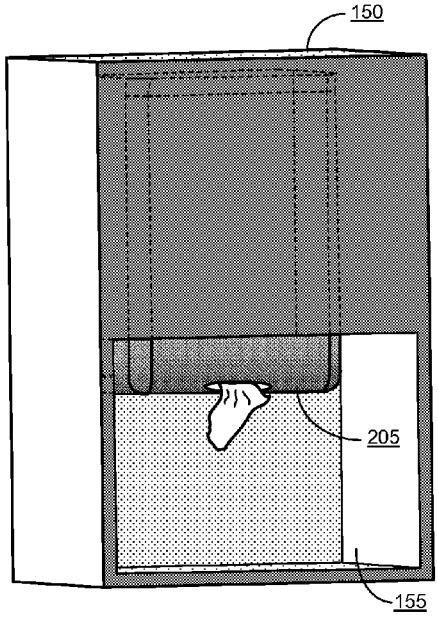

FIGS. 2A through 2D depict various embodiments of a hand sanitizer compartment embedded into a fuel pump dispenser. FIG. 2A depicts a hand sanitizer compartment 150 that supports a touch free hand sanitizer 200. When a hand is placed into opening 155 underneath touch free hand sanitizer 200, touch free hand sanitizer 200 automatically dispenses a portion of sanitizing gel or foam (or any other type of sanitizing product) into the hand (e.g., via an infrared sensor, motion sensor, capacitive flux sensor, etc.). Such a touch free hand sanitizer 200 may be powered by batteries or otherwise coupled to fuel pump dispenser 100 for a power source. In one embodiment, touch free hand sanitizer 200 further includes a timing, sensing and/or activation circuit that is configured so that touch free hand sanitizer 200 is only activated to dispense sanitizing product when a patron completes fueling of his vehicle and returns fuel pump 105 to return carriage 107. FIG. 2B depicts a hand sanitizer compartment 150 that supports a moist towelette or clean wipe dispenser 205. A patron reaches into opening 155 and takes a most towelette or clean wipe (sealed or unsealed) from dispenser 205.

Figure 2C:
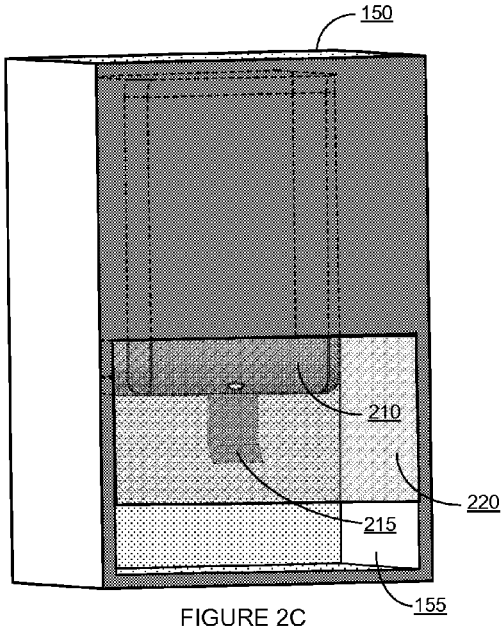
Figure 2D:
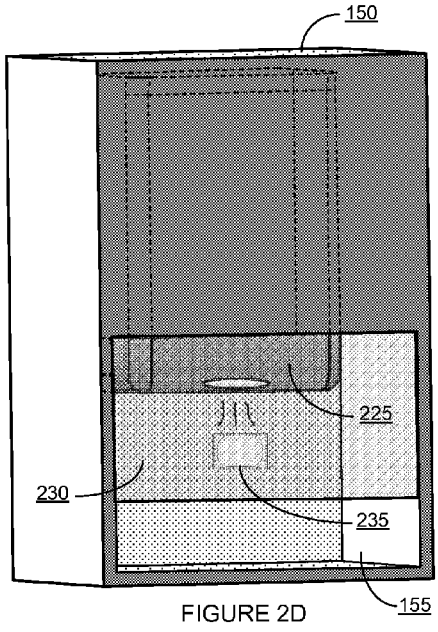

FIG. 2C depicts a hand sanitizer compartment 150 that supports a manual hand sanitizer 210 that dispenses a portion of sanitizing gel or foam when its lever 215 is depressed. The hand sanitizer compartment 150 of FIG. 2C also includes a transparent pane 220 that opens and closes to protect the hand sanitizer from the external environment and unfettered access to the hand sanitizer. In one embodiment, transparent pane 220 automatically retracts upward when a patron completes fueling his vehicle and returns fuel pump 105 to return carriage 107. Transparent pane 220 automatically closes after a pre-determined time interval or after a motion sensing mechanism (e.g., infra-red sensor, etc.) of compartment 150 recognizes that the patron's hand has been removed from opening 155. In an alternative embodiment, transparent pane 220 can be manually opened or closed and may be automatically unlocked when a patron completes fueling his vehicle and returns fuel pump 105 to return carriage 107 (and locked after the patron completes accessing the hand sanitizer). FIG. 2D depicts a hand sanitizer compartment 150 that supports a sealed moist towelette dispenser 225 and a transparent pane 230. In one embodiment, dispenser 225 automatically dispenses a sealed moist towelette 235 upon request by a patron (e.g., after requesting one by interacting with media system 115) after completion of fueling his vehicle. Similar to FIG. 2C, transparent pane 230 automatically closes after a pre-determined time interval or after a sensing mechanism in hand sanitizer compartment 150 recognizes that the patron's hand has been removed from opening 155, or alternatively can be manually opened or closed and may be automatically unlocked when a patron completes fueling his vehicle and returns fuel pump 105 to return carriage 107 (and locked after the patron completes access of the hand sanitizer). It should be recognized that any combination of the features of any of FIGS. 2A-2D may be utilized in alternative embodiments of hand sanitizer compartment 150 consistent with the teachings herein.

Figure 3:
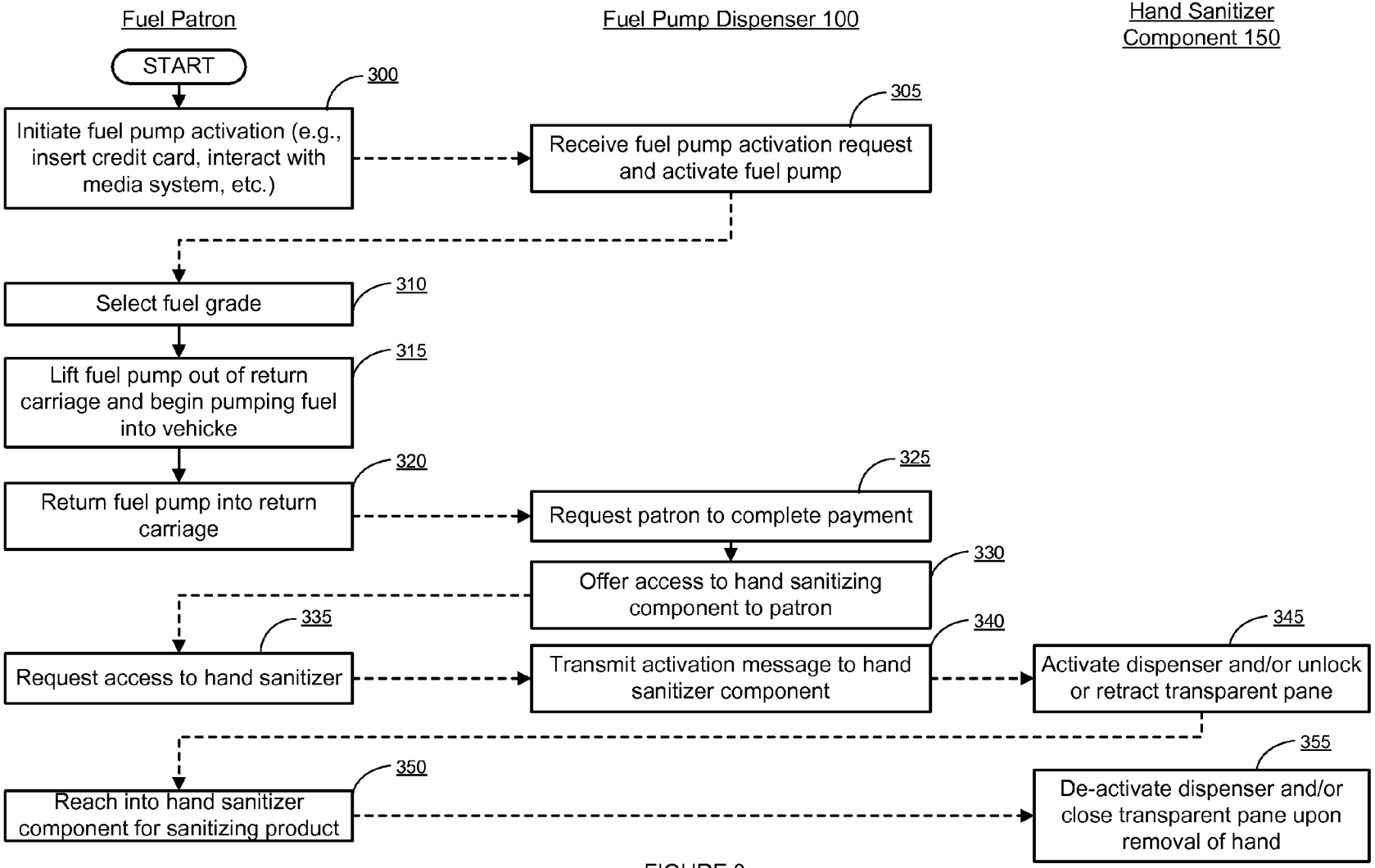
FIG. 3 depicts a flow chart for enabling a hand sanitizer device during a fuel pumping session.

FIG. 3 depicts a flow chart for enabling a hand sanitizer device during a fuel pumping session. In step 300, a patron requests activation of the fuel pump by inserting his credit card into bar scanner 125 or otherwise communicating with the media system of the fuel pump dispenser 100 by interacting with media system display 115. In response, fuel pump dispenser 100 receives the initiation request and activates the pump in step 305. In step 310, the patron selects a fuel grade and in step 315 lifts fuel pump 105 out of return carriage 107 and begins pumping fuel into his vehicle. In step 320, the patron completes pumping fuel into his vehicle and returns fuel pump 105 into return carriage 107. Once fuel pump 105 is placed in return carriage 107, fuel pump dispenser 100 recognizes that the patron has completed fueling and, in step 325, requests the patron to complete payment, for example, by displaying an offering for a receipt through media system display 115. In step 330, fuel pump dispenser 100 further offers the patron to clean his hands by accessing hand sanitizer compartment 150, for example, by displaying a message in media system display 115. In one embodiment, the offer in the message may ask whether the patron desires to purchase access to the hand sanitizer compartment 150, for example, for 10 cents (or any other reasonable amount), while in another embodiment, the offer may be free. In step 335, the patron requests access to hand sanitizer compartment 150 by interacting with media system display 115. In one embodiment, such an access request causes the fuel pump dispenser 100 to interact with an in-store point of sale terminal and/or store controller that assists in completion of a payment transaction for access to the hand sanitizer compartment 150.

In response, in step 340, fuel pump dispenser transmits an activation message to the hand sanitizer dispenser of hand sanitizer compartment 150. In step 340, the hand sanitizer dispenser is activated (e.g., if automatic) and if it has a transparent pane, the transparent pane is unlocked, retracted or otherwise opened. In step 345, the patron reaches into hand sanitizer compartment opening 155 and is dispensed sanitizing product (e.g., either a portion of product or a sealed on unsealed moist towelette, depending upon the embodiment of the hand sanitizer dispenser). In an embodiment that dispenses sealed moist towelettes, a single moist towelette may be automatically dispensed from the dispenser and dropped into opening 155. In step 350, the patron removes his hand and, in step 355, hand sanitizer compartment 150 closes the transparent pane or deactivates the dispenser (e.g., if automatic). In one embodiment, the media system of fuel pump dispenser 100 transmits a deactivation signal to hand sanitizer compartment 150 after a predetermined (and configurable) time interval. In such an embodiment, the hand sanitizer dispenser of hand sanitizer compartment 150 includes an activation and deactivation circuit to receive such messages from fuel pump dispenser 100. In an alternative embodiment, the hand sanitizer dispenser includes its own timing circuit which deactivates the dispensers automatic dispensing capabilities after a predetermined (and configurable) amount of time. In an alternative embodiment, hand sanitizer compartment 150 includes an infrared or other motion sensor that recognizes the removal of the patron's hands and deactivates and sensor and/or closes the transparent pane upon such removal.

Figure 4:
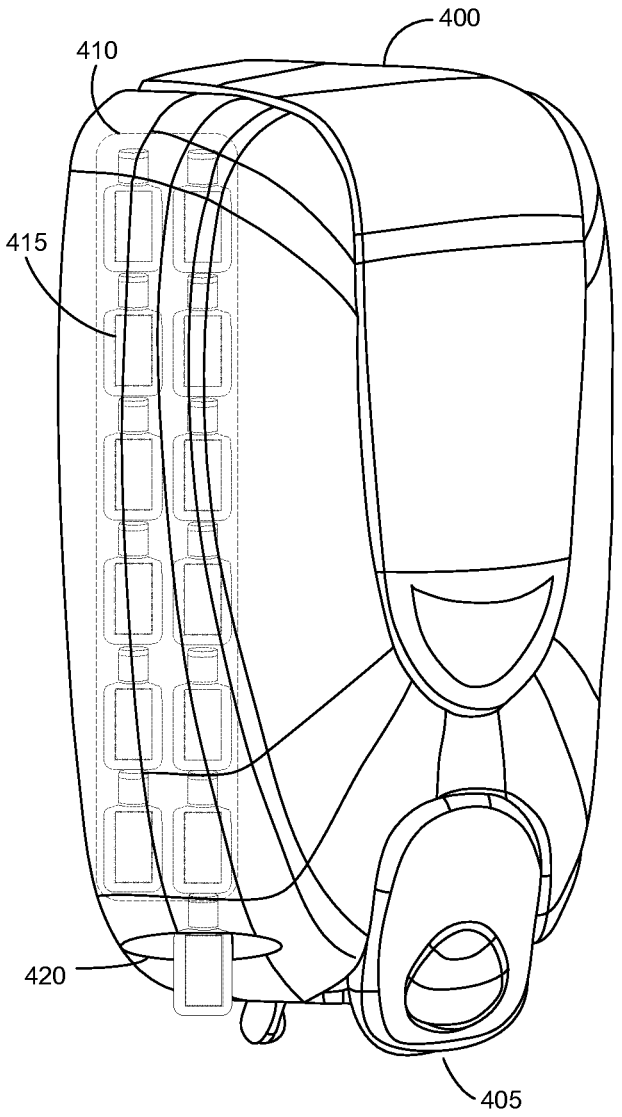
FIG. 4 depicts a hand sanitizer dispenser according to one embodiment.

FIG. 4 depicts a hand sanitizer dispenser according to one embodiment. In one environment, hand sanitizer dispenser 400 of FIG. 4 is attached to fuel pump dispenser 100, for example, to a front or side panel, etc., although it should be recognized that hand sanitizer dispenser 400 may be used in alternative environments, such as airports, shopping malls, supermarkets, hospitals, doctors' offices and any other environment where persons may desire sanitizing their hands. Embodiments of hand sanitizer dispenser 400 are similar to dispensers 200, 205, 215 and 235 of FIGS. 2A-2B in that hand sanitizer 400 dispenses liquid-based sanitizer product (e.g., gels, foams, etc.) from a dispensing outlet 405 and may be either touch free (e.g., electronically controlled to recognize the presence of a hand underneath) or manually triggered (e.g., through a lever or button, etc.). Hand sanitizer 400 also includes a storage compartment 410 that can store a number of hand sanitizer bottles 415 or other sealed and/or packaged hand sanitizer product that can be dispensed from a second dispensing outlet 420. For example, in one embodiment where hand sanitizer dispenser 400 is attached to fuel pump dispenser 100, the liquid-based sanitizer product dispensed from dispensing outlet 405 may be offered for free or for a nominal fee (e.g., 10 cents, etc.) while the bottled hand sanitizers 415 may be purchased and dispensed from second dispensing outlet 420 at a retail price. As similarly discussed previously, media system display 115 of fuel pump dispenser 100 may display a message to a patron asking whether the patron desires to purchase a bottle of hand sanitizer 420 or receive a portion of liquid-based hand sanitizer (e.g., either for free or for nominal fee, etc.), for example, when the patron has completed fueling his vehicle. If the response of the patron relates to a payment transaction, then fuel pump dispenser 100 may interact with an in-store point of sale terminal and/or store controller that assists in completion of a payment transaction (e.g., either to pay for a bottle of hand sanitizer 420 or to receive a one-time portion of liquid-based hand sanitizer) and also appropriately sends an activation signal to a circuit or other computing system of hand sanitizer dispenser 400 to accordingly activate dispensing outlet 405 to dispense liquid-based hand sanitizer or dispensing outlet 425 to dispense a bottle of hand sanitizer (e.g., as purchased). In one embodiment, the circuit or computing system of hand sanitizer dispenser 400 communicates wirelessly (e.g., WiFi, Bluetooth or any other similar radio technologies) with the computing system of fuel pump dispenser 100 while in an alternative embodiment, the circuit or computing system of hand sanitizer is physically coupled to the computing system of fuel pump dispenser 100. In one embodiment, hand sanitizer 400 may include a visual signal (such as a green or red light) that enables a patron to determine whether dispensing outlet 405 has been activated and will dispense liquid-based hand sanitizer. In alternative environments, hand sanitizer dispenser 400 may further include its own point of sale computing system (e.g., including an interface for sliding a credit card or other payment mechanism as well as a user interface display, etc.) to so that bottles of hand sanitizers 420 can be purchased and accordingly dispensed without relying on computing system of fuel pump dispenser 100.

It should be recognized that various modifications and changes may be made to the specific embodiments described herein without departing from the broader spirit and scope of the invention as set forth in the appended claims. For example, rather than a having separate hand sanitizer compartment for each fuel pump dispenser at a fuel station, multiple fuel pump dispensers can share access to a standalone hand sanitizer compartment.

The various embodiments described herein may employ various computer-implemented operations involving data stored in computer systems. For example, these operations may require physical manipulation of physical quantities usually, though not necessarily, these quantities may take the form of electrical or magnetic signals where they, or representations of them, are capable of being stored, transferred, combined, compared, or otherwise manipulated. Further, such manipulations are often referred to in terms, such as producing, identifying, determining, or comparing. Any operations described herein that form part of one or more embodiments of the invention may be useful machine operations. In addition, one or more embodiments of the invention also relate to a device or an apparatus for performing these operations. The apparatus may be specially constructed for specific required purposes, or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

The various embodiments described herein may be practiced with other computer system configurations including hand-held devices, microprocessor systems, microprocessor-based or programmable consumer electronics, minicomputers, mainframe computers, and the like.

One or more embodiments of the present invention may be implemented as one or more computer programs or as one or more computer program modules embodied in one or more computer readable media. The term computer readable medium refers to any data storage device that can store data which can thereafter be input to a computer system computer readable media may be based on any existing or subsequently developed technology for embodying computer programs in a manner that enables them to be read by a computer. Examples of a computer readable medium include a hard drive, network attached storage (NAS), read-only memory, random-access memory (e.g., a flash memory device), a CD (Compact Discs) CD-ROM, a CD-R, or a CD-RW, a DVD (Digital Versatile Disc), a magnetic tape, and other optical and non-optical data storage devices. The computer readable medium can also be distributed over a network coupled computer system so that the computer readable code is stored and executed in a distributed fashion.

Although one or more embodiments of the present invention have been described in some detail for clarity of understanding, it will be apparent that certain changes and modifications may be made within the scope of the claims. Accordingly, the described embodiments are to be considered as illustrative and not restrictive, and the scope of the claims is not to be limited to details given herein, but may be modified within the scope and equivalents of the claims. In the claims, elements and/or steps do not imply any particular order of operation, unless explicitly stated in the claims.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the invention(s). In general, structures and functionality presented as separate components in exemplary configurations may be implemented as a combined structure or component. Similarly, structures and functionality presented as a single component may be implemented as separate components. These and other variations, modifications, additions, and improvements may fall within the scope of the appended claims(s).

I claim:

1. A hand sanitizer dispenser device comprising:

a housing configured to dispense only hand sanitizer product;

a first compartment within the housing to store liquid-based hand sanitizer product;

a second compartment within the housing to store a plurality of packaged hand sanitizer product;

a first dispensing outlet coupled to the first compartment to dispense liquid-based hand sanitizer product from the housing for single use; and a second dispensing outlet coupled to the second compartment to dispense packaged hand sanitizer product from the housing.

2. The hand sanitizer dispenser device of claim 1, attached to a fuel pump dispenser.

3. The hand sanitizer dispenser device of claim 1, further comprising an activation circuit for activating dispensing capabilities of at least one of the first and second dispensing outlets, wherein the activation circuit is configured to receive an activation signal and activate the at least one dispensing outlet in response to the receipt of the activation signal.

4. The hand sanitizer dispenser device of claim 3, wherein the activation circuit is part of a computing system that wirelessly communicates with a computer system coupled to a fuel pump dispenser.

5. The hand sanitizer dispenser device of claim 4, wherein the activation signal is transmitted to the hand sanitizer dispenser by the computer system upon an agreement by a patron to pay for hand sanitizer.

6. The hand sanitizer dispenser device of claim 1, further comprising a point-of-sale computing system within the housing.

7. The hand sanitizer dispenser device of claim 1, further comprising a light to indicate whether the first dispensing outlet has been activated.

8. A fuel pump dispenser configured to provide hand sanitization after pumping fuel comprising:

a display for communicating with a patron;

a computer system coupled to the display; and a hand sanitizer dispenser device comprising a housing configured to dispense only hand sanitizer product, a first dispensing outlet to dispense liquid-based hand sanitizer product for single use, and a second dispensing outlet to dispense packaged hand sanitizer product.

9. The fuel pump dispenser of claim 8, wherein the hand sanitizer dispenser further comprises an activation circuit for activating dispensing capabilities of at least one of the first and second dispensing outlets, wherein the activation circuit is configured to receive an activation signal from the computer system and activate the at least one dispensing outlet in response to the receipt of the activation signal.

10. The fuel pump dispenser of claim 9, wherein the activation circuit is part of a computing system that wirelessly communicates with the computer system.

11. The fuel pump dispenser of claim 10, wherein the activation signal is transmitted to the hand sanitizer dispenser by the computer system upon an agreement by a patron to pay for hand sanitizer.

12. The fuel pump dispenser of claim 8, wherein the hand sanitizer dispenser further comprises a point-of-sale computing system.

13. The fuel pump dispenser of claim 8, wherein the hand sanitizer dispenser further comprises a storage compartment for storing a plurality of packaged hand sanitizer products that can be dispensed from the second dispensing outlet.

14. The fuel pump dispenser of claim 8, wherein hand sanitizer dispenser further comprises a light to indicate whether the first dispensing outlet has been activated.

15. A method performed by a computing system of fuel pump dispenser comprising:

requesting a patron to indicate whether the patron is interested in purchasing a packaged hand sanitizer product;

receiving an indication from the patron indicating an interest in purchasing the packaged hand sanitizer product; and transmitting an activation signal to a hand sanitizer dispenser device configured to dispense only hand sanitizer product and attached to the fuel pump dispenser, wherein (i) the activation signal activates a dispensing mechanism of the hand sanitizer dispenser to dispense the packaged hand sanitizer product, and (ii) the hand sanitizer dispenser is further capable of dispensing a portion of liquid-based hand sanitizer.

16. The method of claim 15, further comprising transmitting an activation signal to the hand sanitizer wherein the activation signal activates the capability to dispense a portion of liquid-based sanitizer.

17. The method of claim 15, further comprising completing a purchase transaction by the patron for a purchase of the packaged hand sanitizer product.

18. The method of claim 15, wherein the activation signal is received wirelessly by a computing system of the hand sanitizer dispenser.

19. The method of claim 15, wherein the hand sanitizer dispenser further comprises a storage compartment for storing a plurality of packaged hand sanitizer products.

* * * * *